US007991338B2

(12) United States Patent
Funabiki

(10) Patent No.: US 7,991,338 B2
(45) Date of Patent: Aug. 2, 2011

(54) BELT-TYPE FIXING DEVICE AND IMAGE FORMING APPARATUS

(75) Inventor: Hiroshi Funabiki, Uenohara (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 405 days.

(21) Appl. No.: 12/144,805

(22) Filed: Jun. 24, 2008

(65) Prior Publication Data

US 2009/0035035 A1 Feb. 5, 2009

(30) Foreign Application Priority Data

Jul. 30, 2007 (JP) ..... 2007-197203

(51) Int. Cl.
*G03G 15/20* (2006.01)

(52) U.S. Cl. ..... 399/329

(58) Field of Classification Search ..... 399/329, 399/333, 331, 328; 219/216, 469–471
See application file for complete search history.

(56) References Cited

U.S. PATENT DOCUMENTS

| | | | | |
|---|---|---|---|---|
| 4,804,576 | A * | 2/1989 | Kuge et al. | |
| 4,883,715 | A * | 11/1989 | Kuge et al. | 219/216 |
| 7,020,423 | B2 * | 3/2006 | Ono et al. | 399/329 |
| 2004/0069404 | A1 * | 4/2004 | Kondoh | |

FOREIGN PATENT DOCUMENTS

| | | | |
|---|---|---|---|
| JP | 61236576 | A * | 10/1986 |
| JP | 5-53467 | A | 3/1993 |
| JP | 10-156841 | A | 6/1998 |
| JP | 2004-94079 | A | 3/2004 |

* cited by examiner

*Primary Examiner* — Susan S Lee
(74) *Attorney, Agent, or Firm* — Sidley Austin LLP

(57) ABSTRACT

A belt-type fixing device having therein a pressure roller that has an elastic layer which is made of solid rubber, wherein, the elastic layer is covered by a resin layer on which a plurality of cracks are formed to be substantially deep enough to arrive at the elastic layer, and cracks harmful for the elastic layer are not caused by pressurization at a nip portion.

11 Claims, 6 Drawing Sheets

BELT-TYPE FIXING DEVICE AND IMAGE FORMING APPARATUS

This application is based on Japanese Patent Application No. 2007-197203 filed on Jul. 30, 2007 in Japanese Patent Office, the entire content of which is hereby incorporated by reference.

BACKGROUND OF THE INVENTION

The present invention relates to a roller having an elastic layer made of solid rubber, and to a belt-type fixing device that uses the roller as a pressure roller and fixes a toner image on a recording material by heating and applying pressure to the toner of the toner image, and further relates to an image forming apparatus equipped with the belt-type fixing device.

In an image forming apparatus of an electrophotographic type such as a copying machine, a printer, a facsimile machine and a multifunctional machine equipped with the aforesaid various functions, a latent image corresponding to a document is formed on a photoconductor, then, the latent image is supplied with toner to become a visible image, and this visible toner image is transferred onto a recording sheet, and after this, the toner image transferred onto the recording sheet is fixed, and the recording sheet is ejected.

When forming a color image, latent images for Y, M, C and K corresponding to a document are formed respectively on four photoconductor drums, then, visualized four toner images are transferred primarily onto an intermediate transfer body composed of an endless belt, and they are transferred secondarily onto a recording sheet, thus, the toner image transferred onto the recording sheet is fixed and the recording sheet is ejected.

As a fixing device that fixes a toner image in the aforesaid way, there is a fixing device of a belt type wherein there are provided an endless fixing belt wound around a heat roller having therein a heating device such as a halogen heater and further around a pressure roller, and an outer pressure roller that presses the pressure roller through the fixing belt, and wherein the recording sheet onto which the toner image has been transferred is heated and pressed in a nip portion formed by the fixing belt and the outer pressure roller while the recording sheet is interposed and conveyed, and a belt-type fixing device of this kind has a merit that warm-up time is shortened, resulting in energy saving because belt-type fixing device of this type has a small heat capacity of fixing belt for the heat roller.

For making fixing at higher speed to be possible, in the belt-type fixing device of this kind, it is necessary to secure a great width of a nip portion. Further, for improving an efficiency of separation from a fixing belt, it is necessary to secure a great curvature on a separating portion on the fixing belt. For both of the foregoing matters mentioned above, it is effective to make an elastic layer of a pressure roller to be lower in hardness.

Though low hardness can be obtained easily in the case of sponge, when it is used for the elastic layer of the pressure roller, pressure in a nip becomes uneven and fine uneven gloss is generated in an image to lower image quality, because of uneven density in sponge. In addition, durability of a roller employing sponge is deteriorated.

Solid rubber gives uniform pressure, and it is free from the image quality decline and durability shortage. However, when rubber of low hardness is used, there is caused a problem of a tack property, resulting in high close adhesion and a state similar to adhesion. In the nip portion, a solid rubber layer is squeezed by high load, and a surface of the solid rubber shrinks once before entering the nip portion, and then is extended gradually as the pressure in the nip portion increases, and after that, a progress opposite to the foregoing is taken after passing the maximum pressure area.

On the other hand, a belt basic body is made of a metal like nickel electroformed metal and a high strength heat-resistant resin such as polyimide, and its elastic modulus is greater than that of rubber, and it hardly shows expansion and contraction. Therefore, it is necessary for the inner surface of the fixing belt to slide on the surface of the pressure roller in the nip portion. However, if a tack property is high, both of them cannot slide easily on each other and troubles that they are forced to slide to generate abnormal noises are generated, or the fixing belt yields and wrinkles are caused thereon.

To avoid the foregoing, it is also possible to grind a solid rubber surface of the pressure roller to acquire an appropriate roughness, and thereby, to make it slide easily. However, in the case of low hardness rubber, the rubber easily becomes a large lump when it is torn off by a grindstone, and thereby, the condition for grinding needs to be controlled extremely strictly for obtaining appropriated roughness, and polishing powder and a portion of rubber immediately before being torn off tend to stay on the surface. After being mounted in a fixing device, uneven pressure distribution is caused in the nip portion by the polishing powder and broken pieces. Further, the polishing powder and others are transferred to a fixing belt and a heat roller, to make heat conduction from the heat roller to be uneven, resulting in uneven temperature of the fixing belt. This unevenness in pressure and temperature results in image defect such as uneven gloss. Further, since the surface is still composed of a rubber of low hardness, tack property to some extent still remains, and even when a fixing belt and a pressure roller can be driven, a state where the pressure roller clings to the inner surface of the fixing belt is generated, in the course of assembling a fixing device, resulting in extremely degraded easiness of assembling. In addition, if they are forced to be assembled, the fixing belt is easily damaged.

Therefore, for preventing the tack property on the surface of the pressure roller, it can be considered that the surface of solid rubber provided on the pressure roller is covered or is coated by a tube of PFA (perfluoroalkoxy) or of PTFE (polytetrafluoroethylene) representing resin with low friction. In this structure, sliding property on a fixing belt is improved by a resin layer.

A fixing device wherein a silicone rubber layer of the pressure roller is covered with PFA tube is known (see Unexamined Japanese Patent Application Publication No. 2004-94079).

A surface roughness corresponding to the use is needed for the surface of an elastic roller used for a copying machine or the like, for securing friction against a recording sheet. However, when the elastic roller is made to be small, lowering the hardness of the elastic layer is necessary, because an elastic layer also becomes thinner. A patent gazette discloses an elastic roller wherein plural fine grooves are formed in the axial direction when producing the elastic roller of this kind, because forming evenly fine irregularities on the surface through conventional grinding processing or electrical discharging machining is not possible. Incidentally, forming of the fine grooves is conducted through injection molding employing a mold that is formed from a mother mold made by grinding processing by a grindstone (see Unexamined Japanese Patent Application Publication No. 10-156841).

Further, the patent gazette discloses a thermal fixing roller wherein highly accurate geometric irregularities are formed on the surface of an elastic layer for preventing a sheet from coiling (see Unexamined Japanese Patent Application Publication No. 5-53467).

However, in Unexamined Japanese Patent Application Publication No. 2004-94079 and No. 10-156841, only an elastic layer is formed on the outer circumferential surface of a core material of the elastic roller. The elastic roller does not have the resin layer on the surface thereof. Therefore in the case that such roller is used with the fixing belt, because such roller has no resin layer, an efficiency of sliding between the fixing belt and the surface of the roller is not smooth and it causes abnormalities on a rotation of the fixing belt.

On the other hands, in unexamined Japanese Patent Application Publication No. 2004-94079, when a resin layer made of PFA or PTFE is formed on the surface of a pressure roller, easiness of sliding on a fixing belt is improved, and no abnormality is caused on rotation of the fixing belt, thereby, neither wrinkles on the recording sheet nor abnormal noises are generated, and a problem that a work efficiency for assembling of a fixing device is lowered is not caused.

However, when a pressure is applied in the nip portion as stated above, a low hardness solid rubber of the pressure roller is crushed, and the surface tends to extend or contract. For obtaining a wide nip portion or a high separation curvature, the solid rubber is transformed greatly, and the elasticity rate without a resin layer becomes to be about ±10%. In the initial state, the resin layer disturbs this transformation and supports, but it cannot support for a long time, because a resin layer is formed as extremely thin as 10-50 μm so that tenderness of the pressure roller may not be deteriorated. Since the resin layer does not have elasticity like that of rubber, the resin layer is gradually expanded while it repeats its passage through the nip portion, and cracks are generated when being expanded. Since there is no support by a resin layer on the portion of the cracks, transformation is concentrated on the rubber layer of that portion, and cracks progress not only on the resin layer but also on the rubber layer. Under such condition, fixing pressure is not applied on the portion of cracks sufficiently, and uneven gloss and fixing troubles are caused. Further it results in a serious destruction (rupture etc.) of the rubber layer in the worst case.

The invention has been achieved in view of the aforesaid problems, and its objective is to propose a roller wherein cracks affecting adversely a resin layer and an elastic layer by pressure are not generated even when an elastic layer is covered by a resin layer, and to propose a belt-type fixing device using the roller as a pressure roller and an image forming apparatus equipped with the belt-type fixing device.

SUMMARY

The objectives stated above are attained by embodiments of the invention described below.

1. A belt-type fixing device having an endless fixing belt, a pressure roller arranged inside the fixing belt and a pressure member which presses the fixing belt against the pressure roller, a toner image on a recording material being fixed in a nip portion formed between the fixing belt and the pressure member, wherein the pressure roller has an elastic layer which is made of solid rubber and a resin layer covering the elastic layer, a plurality of cracks being formed on the resin layer so as to be substantially deep enough to arrive at the elastic layer.

2. An image forming apparatus having the belt-type fixing device of Item 1.

DETAILED DESCRIPTION OF THE PREFERRED EMBODIMENT

Embodiments concerning an image forming apparatus of the invention will be described as follows, referring to drawings.

Figure 1:
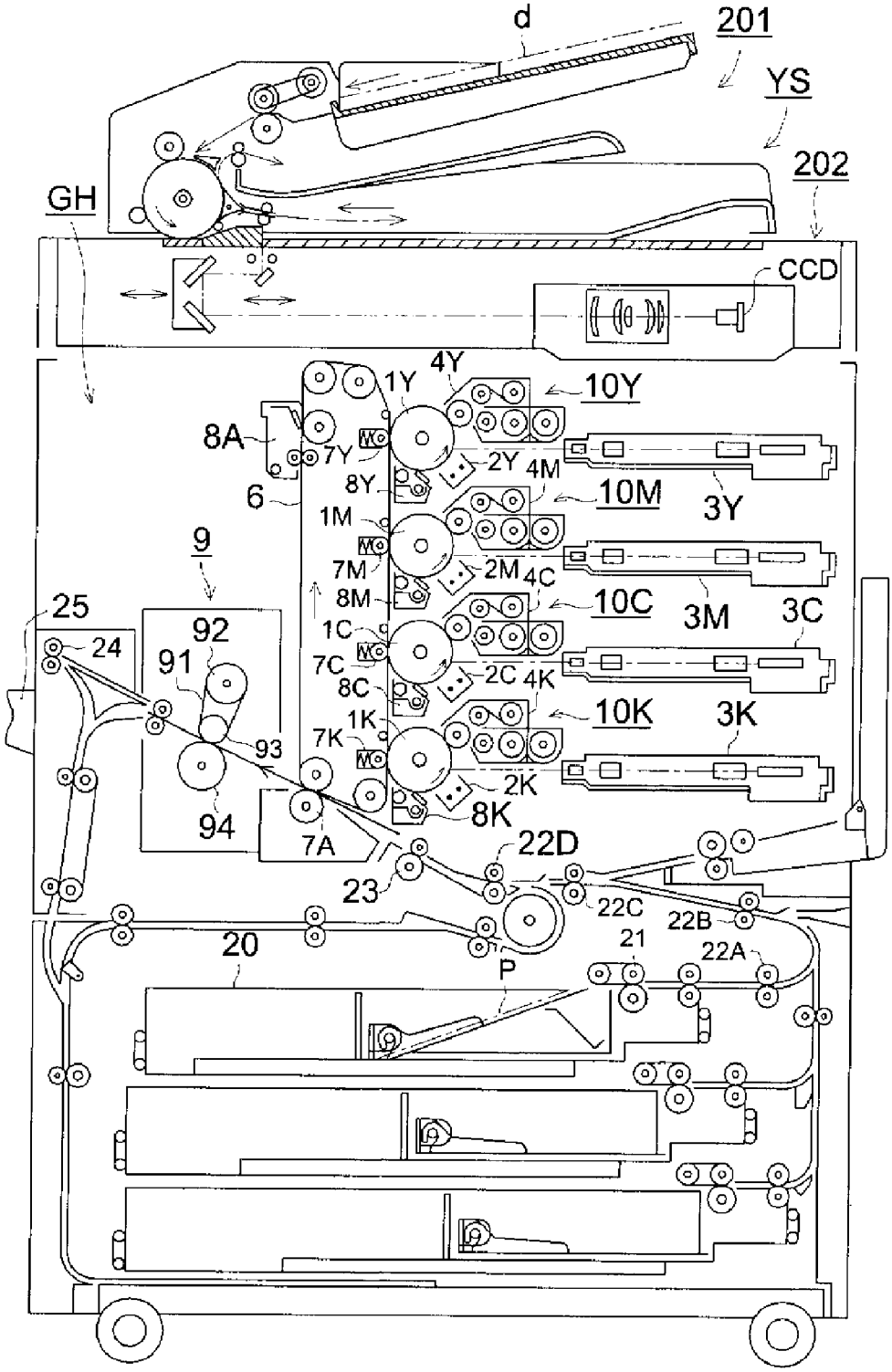
FIG. 1 is a structural diagram of an image forming apparatus.

First, an example of the image forming apparatus will be described based on a structural diagram in FIG. 1.

The image forming apparatus is composed of image forming apparatus main body GH and image reading device YS.

The image forming apparatus main body GH is called a color image forming apparatus of a tandem type which is composed of plural sets of image forming sections 10Y, 10M, 10C and 10K, belt-shaped intermediate transfer body 6, a sheet conveyance device and of fixing device 9.

On the upper potion of the image forming apparatus main body GH, image reading device YS that is composed of automatic document feeding device 201 and document image scanning exposure device 202 is installed. Document d placed on a document table of the automatic document feeding device 201 is conveyed by a conveyance device, then, images on one side of the document or of both sides thereof are exposed through scanning by an optical system of the document image scanning exposure device 202 to be read into line image sensor CCD.

Signals which have been formed through photoelectric transduction conducted by the line image sensor CCD are subjected to analog processing, A/D conversion, shading correction and image compression processing, and are sent to exposure devices 3Y, 3M, 3C and 3K.

In the image forming section 10Y that forms an image in yellow (Y) color, charging device 2Y, exposure device 3Y, developing unit 4Y and cleaning device 8Y are arranged around photoconductor drum 1Y. In the image forming section 10M that forms an image in magenta (M) color, charging device 2M, exposure device 3M, developing unit 4M and cleaning device 8M are arranged around photoconductor drum 1M. In the image forming section 10C that forms an image in cyan (C) color, charging device 2C, exposure device 3C, developing unit 4C and cleaning device 8C are arranged around photoconductor drum 1C. In the image forming section 10K that forms an image in black (K) color, charging device 2K, exposure device 3K, developing unit 4K and cleaning device 8K are arranged around photoconductor drum 1K. Latent image forming devices are composed of charging device 2Y, exposure device 3Y, charging device 2M, exposure device 3M, charging device 2C, exposure device 3C, charging device 2K and exposure device 3K.

Incidentally, each of the developing units 4Y, 4M, 4C and 4K contains two-component developer composed of carrier and small diameter particle toner in each of yellow (Y), magenta (M), cyan (C) and black (K) colors.

The intermediate transfer body 6 is wound around plural rollers, and is driven to circulate.

Fixing device 9 has therein endless fixing belt 91 that is wound around heat roller 92 and pressure roller 93 to be driven to circulate and an outer pressure roller 94 that presses the pressure roller 93 through the fixing belt 91, and the fixing device 9 fixes a toner image on recording material (recording sheet) P through heating and pressing in a nip portion formed between the fixing belt 91 and the outer pressure roller 94.

Images formed by image forming sections 10Y, 10M, 10C and 10K in each color respectively, are transferred (primary transfer) one by one on rotating intermediate transfer body 6 respectively by transfer devices 7Y, 7M, 7C and 7K, thus, a toner image of composite color images is formed. Recording sheet P stored in sheet feed cassette 20 is fed by sheet feeding device 21 and is conveyed to transfer device 7A through sheet-feed rollers 22A, 22B, 22C, 22D and registration roller 23, and a color image is transferred onto recording material P (secondary transfer). The recording material P on which the color image has been transferred is heated and pressed in fixing device 9, and the color toner image is fixed on the recording material P. After that, the recording material P is interposed between sheet ejection rollers 24 to be placed on sheet ejection tray 25 outside the apparatus.

On the other hand, after the color image is transferred onto the recording material P by the transfer device 7A, intermediate transfer body 6 from which the recording material P has been curvature-separated is cleaned by cleaning device 8A so that residual toner may be removed.

Incidentally, though the foregoing is for the image forming apparatus for forming a color image, the invention can also be applied to an image forming apparatus for forming a black-and-white image.

Next, a fixing device relating to the invention will be described based on a sectional view in FIG. 2.

The fixing belt 91 is formed to be endless, and for example, PI (polyimide) having a thickness of 70 μm or nickel electroformed having a thickness of 40 μm is used, and an outer circumferential surface of the basic body is covered with a heat-resistant silicone rubber (hardness JIS-A30°) having a thickness 200 μm as an elastic layer, and it is further covered with a tube of PFA (perfluoroalkoxy) representing heat-resistant resin having a thickness of 30 μm. Meanwhile, a dimension of an inside diameter is 80 mm, for example.

Heat roller 92 has therein built-in halogen lamp 92A representing a heating device that heats fixing belt 91, and for example, an outer circumferential surface of cylindrical core metal 92B that is made of aluminum and has its wall thickness of 2 mm is covered with resin layer 92*c* that is coated with PFA whose thickness is 30 μm. Incidentally, a dimension of an outside diameter is, for example, 52 mm.

As halogen lamp 92A, a portion of 930 W and a portion of 600 W are provided to make heat distribution different in the axial direction, to cope with different sheet widths.

In pressure roller 93 (the roller described in Item 1), solid core metal 93A made of metal such as iron is covered with silicone rubber (hardness JIS-A10°) representing heat resistant solid rubber and having a thickness of 7 mm as elastic layer 93B, and it is further covered with resin layer 93C coated with PTFE (polytetrafluoroethylene) representing a low-friction and heat resistant resin with a thickness of 30 μm. Incidentally, a dimension of an outside diameter is, for example, 40 mm.

Outer pressure roller 94 (pressure member) has therein built-in halogen lamp 94A representing a heating device that heats fixing belt 91, and an outer circumferential surface of cylindrical core metal 94B that is made of aluminum or the like and has its wall thickness of 2 mm is covered by heat resistant silicone rubber (hardness JIS-A20°) as an elastic layer 94C, and it is further covered by resin layer 94D of PFA tube having a thickness of 30 μm. Incidentally, a dimension of an outside diameter, for example, is 50 mm.

Owing to an unillustrated biasing device, the outer pressure roller 94 causes fixing belt 91 to come in pressure contact with pressure roller 93.

As halogen lamp 94A, the power is 530 W, for example, and it has a uniform heat emitting distribution.

There are further provided temperature sensor S1 that detects a temperature at the portion where the fixing belt 91 is wound around, temperature sensor S2 that detects a temperature of the fixing belt 91 immediately before nip portion N and temperature sensor S3 that detects a temperature of the outer pressure roller 94.

Any type of a heating device can also be used, as a heating device that heats fixing belt 91, and for example, an induction heating element employing an exciting coil can be used. In addition, a heating device does not always need to be arranged in heat roller 92, and it may be arranged anywhere.

Further, the fixing device may also be equipped with a tension roller that presses a fixing belt.

In the aforesaid structure, when pressure roller 93 is rotated clockwise by an unillustrated driving device, fixing belt 91 and heat roller 92 are also rotated clockwise, while, outer pressure roller 94 rotates counterclockwise. The outer pressure roller 94 may also be driven. Further, fixing belt 91 that comes in contact with heat roller 92 is heated by halogen lamp 92A, and the outer pressure roller 94 is also heated by halogen lamp 94A. Then, since the outer pressure roller 94 is biased in the direction of pressure roller 93 by an unillustrated biasing device, the fed recording material P is heated and pressed and the toner image on the recording material P is fixed in nip portion N between fixing belt 91 wound around pressure roller 93 and outer pressure roller 94.

Figure 2:
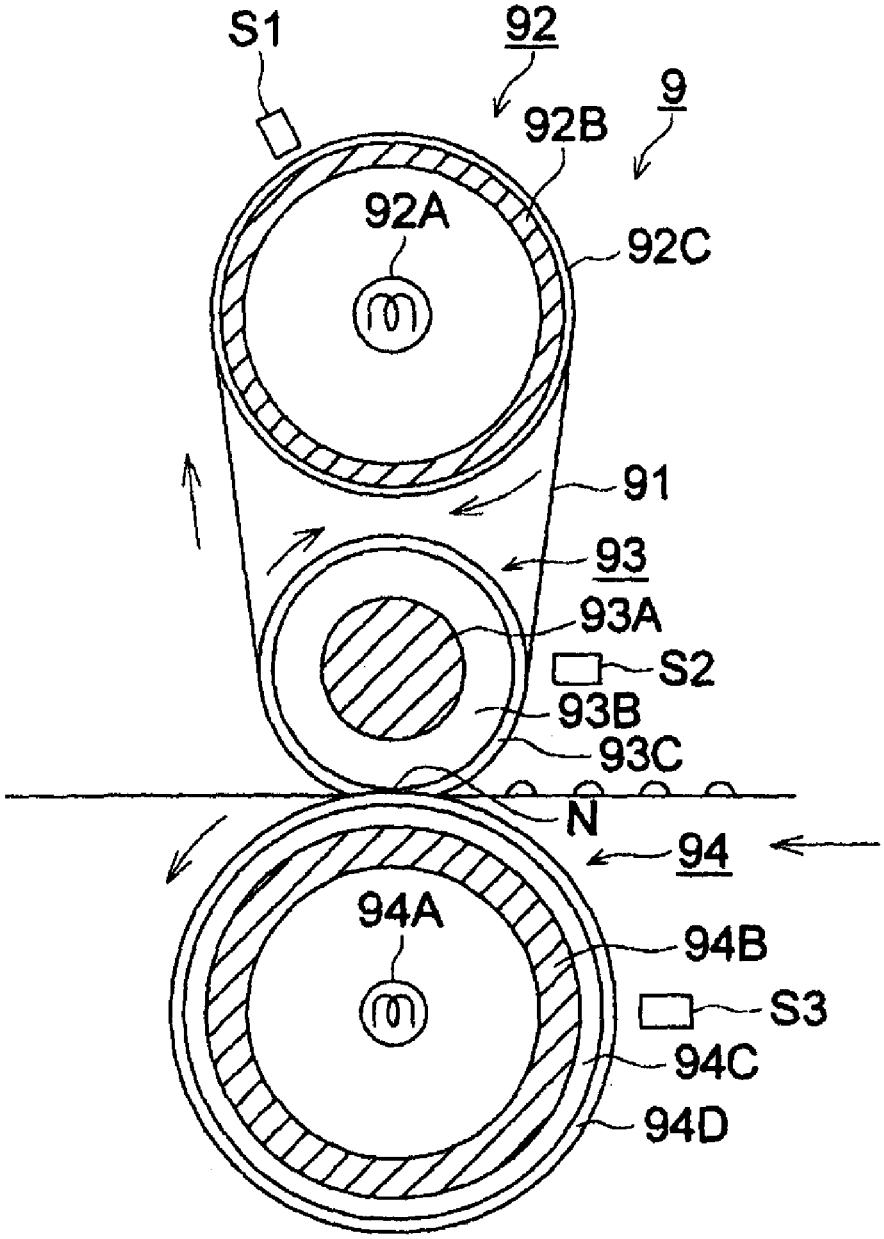
FIG. 2 is a sectional view of a fixing device.

In the fixing device shown in FIG. 2, heat roller 92 is positioned directly above pressure roller 93, and nip portion N is formed on a straight line passing through a center of the heat roller 92 and a center of the pressure roller 93. However, it is not necessary to be limited to this, and it is also possible to arrange so that the heat roller 92 is located on the side of pressure roller 93, and nip portion N is formed on the portion that is not on the straight line.

With respect to the belt-type fixing unit of this sort, when elastic layer 93B of pressure roller 93 is covered by resin layer 93C made of PTFE, in a conventional belt-type fixing unit, there has been a possibility that resin layer 93C is transformed by pressure at nip portion N to generate cracks partially, and stress is concentrated on elastic layer 93B at the portion where the cracks have been generated, and therefore cracks are further generated also on elastic layer 93B, resulting in the rupture thereof.

Figure 3:
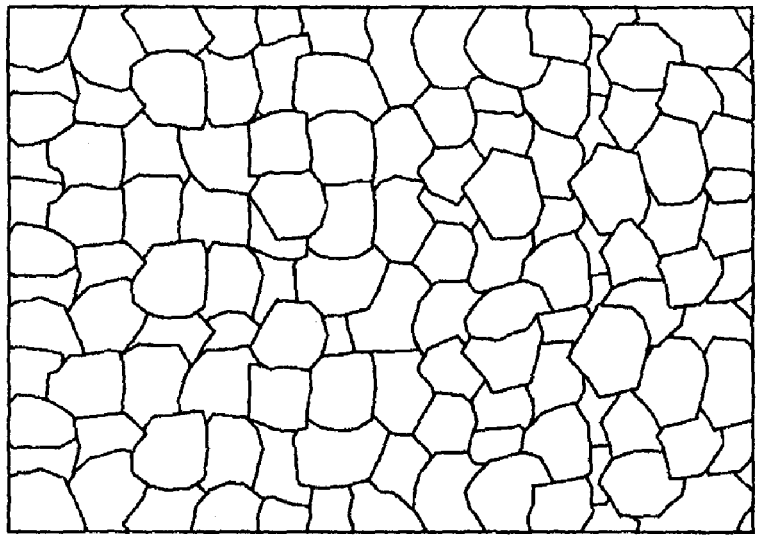
FIGS. 3(A) and 3(B) are schematic diagrams of a plurality of cracks.
Figure 3:
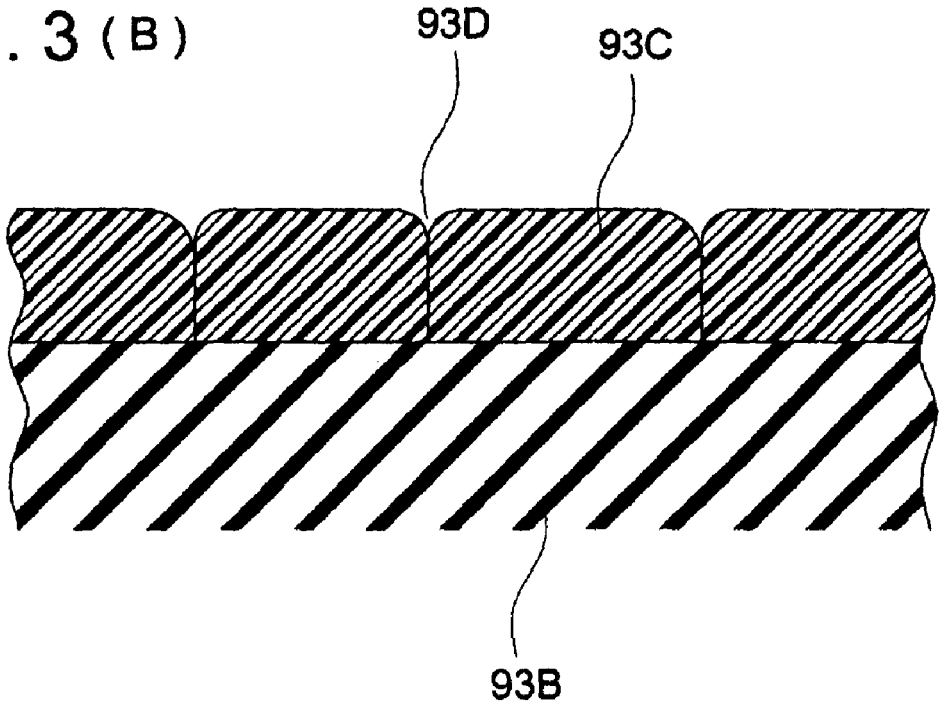

To solve this problem, a plurality of cracks each being in a different direction are formed on resin layer 93C in advance, on pressure roller 93 of the invention. As an example, when resin layer 93C is formed by coated PTFE powder, plural cracks are generated on the resin layer 93C. FIG. 3 (A) is a diagram showing the state of cracks schematically.

As shown in FIG. 3 (A), plural cracks each being in a different direction are formed on the resin layer to be in a honeycomb pattern. The honeycomb pattern is formed to be in a size of 0.05-1 mm, among which the size of 0.5 mm or less is preferable. A thickness of the resin layer is 10-100 μm.

FIG. 3 (B) is a schematic diagram of a crack cross-section of resin layer 93C. When force to be extended laterally is applied, crack 93D is spread, and a load applied on resin layer 93C is greatly reduced.

Owing to this, when pressure is applied at nip portion N, cracks formed in advance on resin layer 93C are spread, and thereby, cracks which adversely affect resin layer 93C are not generated newly. Further, owing to a large number of cracks formed in advance, stress concentration on elastic layer 93B is dispersed, and transformation of the outermost layer of the elastic layer 93B is dispersed, which causes no rupture of the elastic layer 93B. In addition, microscopically, a portion of a honeycomb pattern comes in contact with a base body of fixing belt 91, and an inner portion of the crack does not make contact with it. Even if the inner portion of the crack makes contact with a base body of fixing belt 91, friction force between pressure roller 93 and fixing belt 91 is small, because the pressure is low. Therefore, fixing belt 91 is not damaged at nip portion N, and abnormal noise is not generated.

Further, when assembling fixing unit 9, elastic layer 93B is hardly transformed, and resin layer 93C only comes in contact with fixing belt 91. Therefore, pressure roller 93 slides easily on an inner side of fixing belt 91, which improves working efficiency in the course of assembling.

Further, fluororubber can also be used suitably as elastic layer 93B in addition to silicon rubber.

Continuous sheet feeding experiments were conducted by use of fixing unit 9 that is structured as shown in FIG. 2 and has pressure roller 93 wherein the plural cracks of this kind are formed on resin layer 93C in advance.

Experimental conditions for the fixing device 92 are as follows.

Fixing load: 700N

Fixing belt tension: 42N

Sheet feeding speed: 150-300 mm/s

Fixing belt control temperature: 150-210° C.

Outer pressure roller control temperature: 120-160° C.

Number of sheets having passed: 600,000 sheets

No problem was caused at all in these experiments.

How to form plural cracks each being in a different direction on resin layer 93C of pressure roller 93 in advance will be described in detail as follows.

First, elastic layer 93B is formed on core bar 93A, then, an adhesive agent is coated on the elastic layer 93B, and PTFE powder having a particle size of 50-1000 μm is sprayed on the elastic layer 93B to be stuck thereon. Or, PTFE powder may also be absorbed electrostatically. As the PTFE powder, those manufactured by DU PONT-MITSUI FLUOROCHEMICALS COMPANY, LTD., for example, are used. Further, burning temperature and burning time are set so that melting and fusion may not be caused between particles of PTFE powder. The burning time is set after making experiments in advance, because it varies depending on material composition and size of PTFE powder and primer, heat conductivity, a thickness of rubber used for elastic layer 93B and on adhesives.

In the present example, fluororubber was used as adhesives, and primary burning was conducted at 180° C. for one hour. After the primary burning, a portion where a rubber layer or a primer layer is largely exposed was removed, and an outermost layer was smoothed generally, by pushing PTFE powder deeply into a primer layer after heating, pressing and rotating the pressure roller 93, and by smashing PTFE powder that was not melted mutually by heat but was softened to the level where it was deformed plastically by pressure. Then, secondary burning was conducted at 230° C. for four hours.

Without having any fusion between powder particles, PTFE is fixed on a surface of a pressure roller under the state wherein a grain boundary in a shape of a honeycomb pattern is left, and it can follow a large surface transformation while keeping its sliding property.

A material for forming resin layer 93C is not limited to PTFE, and other resin materials can also be used, and PEEK (polyetheretherketone), for example, is preferable. When comparing with PTFE, PEEK is more excellent in heat resistance, and its adhesive strength is greater though its sliding property is slightly inferior. Therefore, when a fixing load is large and an amount of transformation of elastic layer 93B grows greater, mechanical durability performance of PEEK is better than that of PTFE, because PEEK is excellent in adhesiveness.

Further, when especially high accuracy is required for a shape of the outside diameter of pressure roller 93 including changing of an outside diameter in the axial direction microscopically, a surface of elastic layer 93B may also be ground before forming resin layer 93C on the elastic layer 93B.

A belt-type fixing device shown in the aforesaid FIG. 2 is of an upper belt type employing a fixing belt on the image surface side, and it is necessary to enhance a set temperature of a fixing belt, for increasing an amount of supply from the fixing belt in view of thermal efficiency. Thus, a temperature of a pressure roller arranged inside the fixing belt rises inevitably, and an elastic modulus of the elastic layer is lowered. Owing to this, a transformation ratio at the nip portion grows greater and subjects of the invention become further greater, resulting in effects which are especially conspicuous.

However, the belt-type fixing device wherein a plurality of cracks dispersed in different directions mentioned above are formed on the pressure roller is not limited to the belt-type fixing device having the structure shown in FIG. 2, and the same effects can also be obtained by a belt-type fixing device in another embodiment. Consequently, FIGS. 4-7 show belt-type fixing devices in other embodiments.

Figure 4:
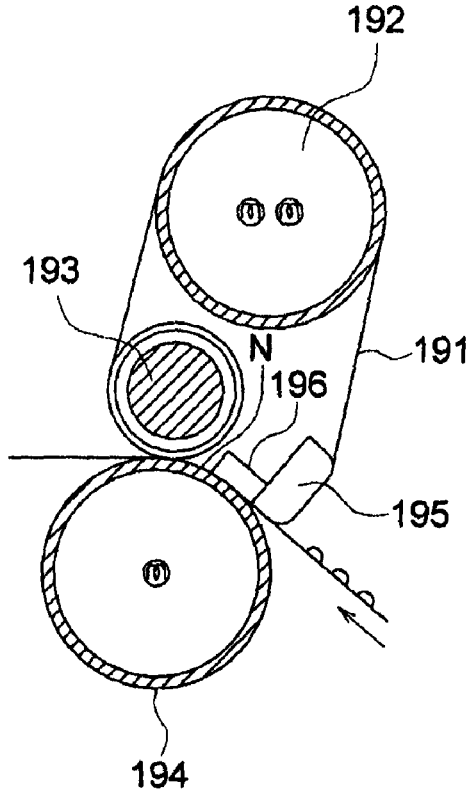
FIG. 4 is a sectional view of a belt-type fixing device of another embodiment.

In the belt-type fixing device shown in FIG. 4, fixing belt 191 is wound around heat roller 192, pressure roller 193 having an elastic layer and a resin layer with prescribed thicknesses and further around guide member 195, and it is supported by an unillustrated supporting member so that a load is applied on outer pressure roller (pressure member) 194. Fixing belt 191 is caused to be pressure contact with outer pressure roller 194 by pressure pad 196 made of silicone rubber that is arranged between pressure roller 193 and guide member 195 from the inside of the fixing belt 191. Due to this, a width of the nip portion N is further increased. The aforesaid plural cracks dispersed in different directions are formed in advance on pressure roller 193. A roller may also be used in place of the pressure pad 196.

Figure 5:
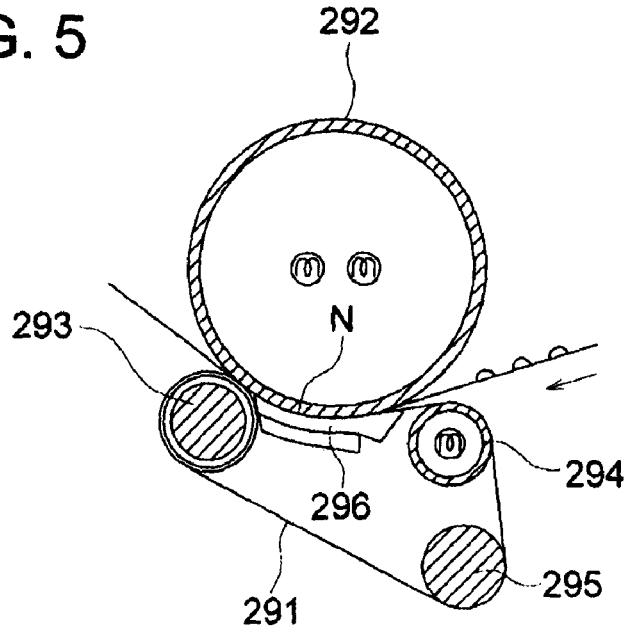
FIG. 5 is a sectional view of a belt-type fixing device of another embodiment.

In the belt-type fixing device shown in FIG. 5, fixing belt 291 is wound around pressure roller 293 having an elastic layer and a resin layer with prescribed thicknesses and is wound around two rollers 294 and 295, and heat roller 292 (pressure member) is in pressure contact with an outer circumferential surface of fixing belt 291. Further, an inner circumferential surface of the fixing belt 291 is held by pressure pad 296. Due to this, a width of the nip portion N is further increased. The aforesaid plural cracks dispersed in different directions are formed in advance on pressure roller 293. Further, pressure roller 293 serves as a separation roller that separates a recording material, and effects in the case of forming the aforesaid plural cracks dispersed in different directions in advance are great, because a load of the separation roller is high, and a transformation ratio of the elastic layer is also great.

Figure 6:
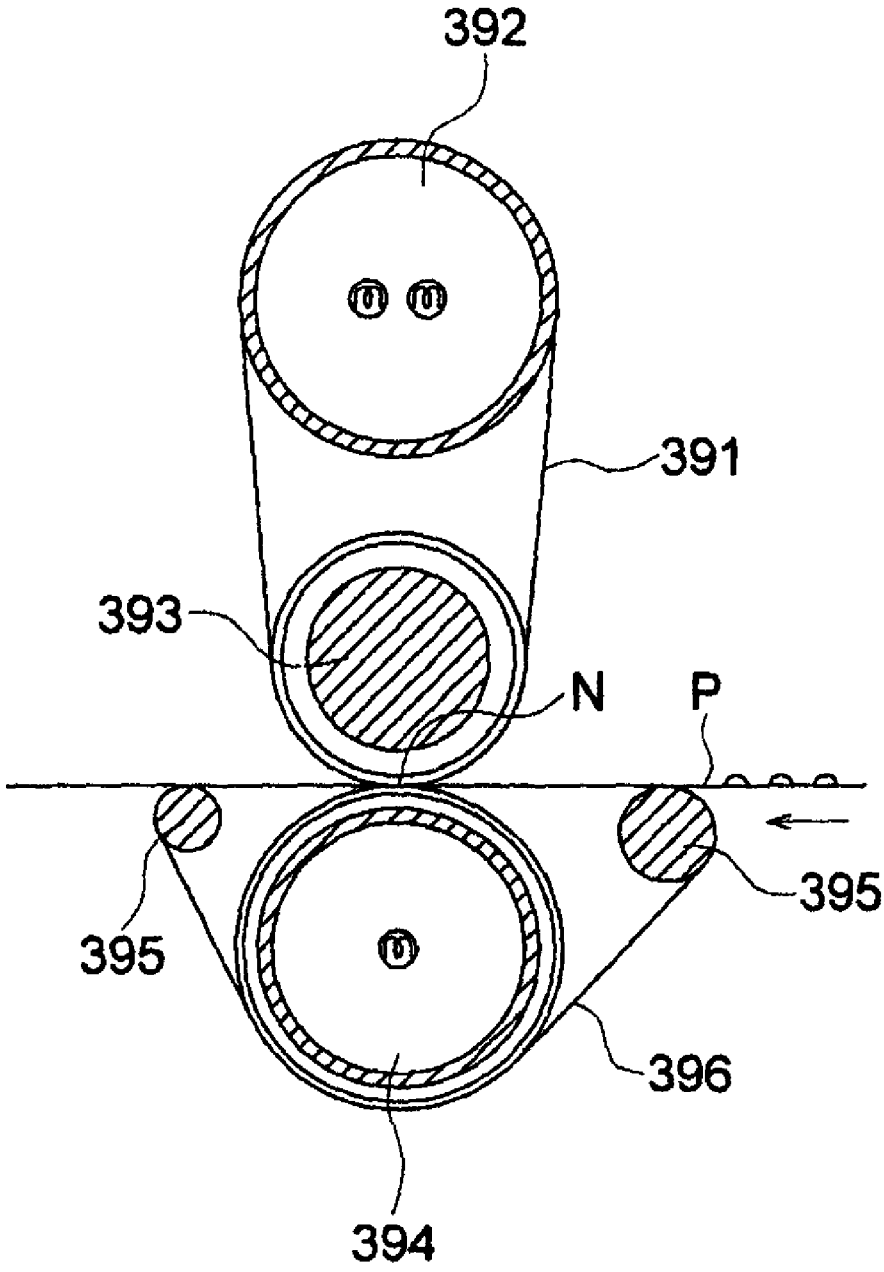
FIG. 6 is a sectional view of a belt-type fixing device of another embodiment.

In the belt-type fixing device shown in FIG. 6, fixing belt 391 is wound around heat roller 392 and around pressure roller 393 on one side, and pressure belt 396 is wound around pressure roller 394 on the other side and around two rollers 395. Each of pressure rollers 393 and 394 has an elastic layer and a resin layer having prescribed thicknesses. Pressure roller 394 presses pressure roller 393 through pressure belt 396 and fixing belt 391. An unfixed image on recording material P is held on pressure belt 396 to be heated in advance in front of nip portion N, thereby, a high fixing characteristic is obtained, and recording material P is conveyed stably by the pressure belt 396 even after passing through the nip portion N. Though pressure roller 394 corresponds to a pressure member against pressure roller 393 in this case, the pressure roller 393 may also be a pressure member against pressure roller 394, and it is desirable that the aforesaid plural cracks dispersed in different directions are formed in advance on both of the pressure roller 393 and pressure roller 394.

Further, a pressure pad may be used as a pressure member in place of pressure roller 394.

Figure 7:
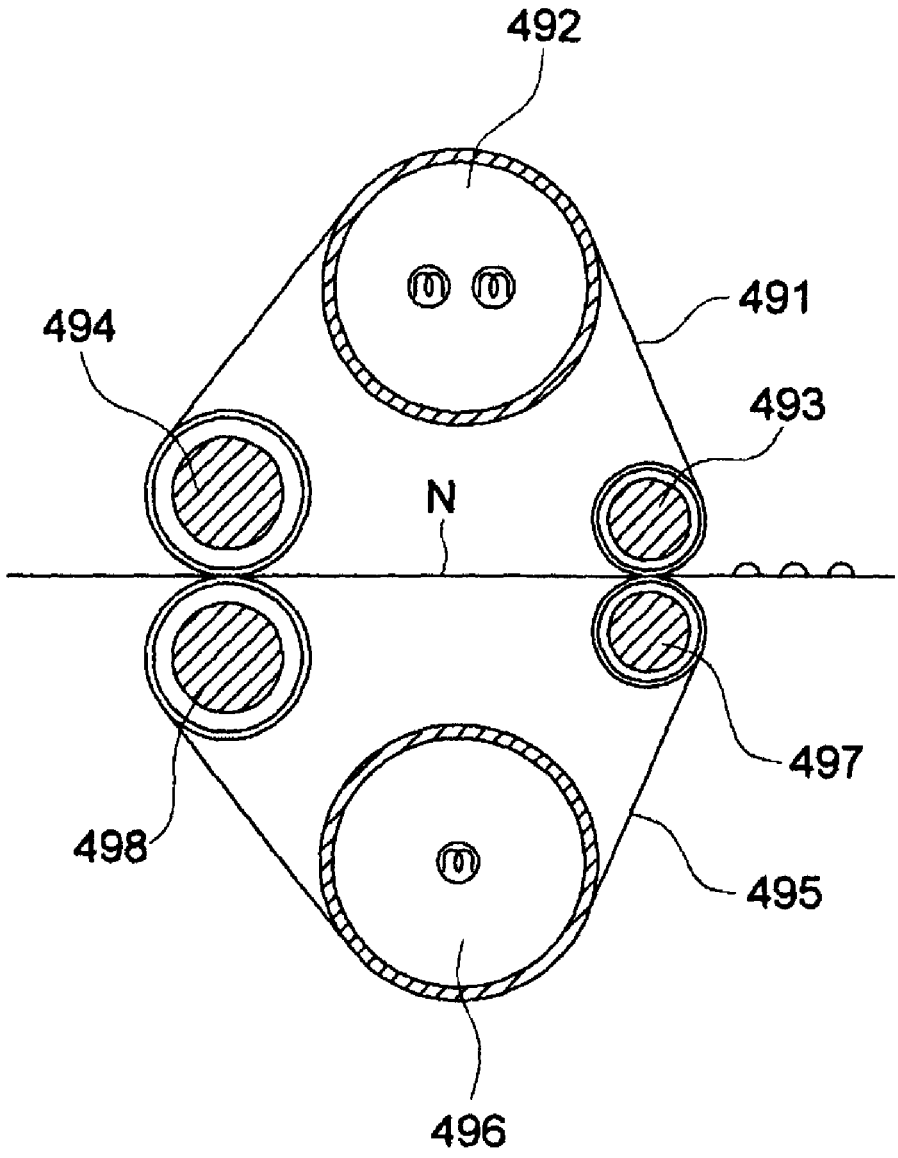
FIG. 7 is a sectional view of a belt-type fixing device of another embodiment.

In the belt-type fixing device shown in FIG. 7, fixing belt 491 is wound around heat roller 492 and two pressure rollers 493 and 494, while, pressure belt 495 is wound around another heat roller 496 and other two pressure rollers 497 and 498. Each of pressure rollers 493, 494, 497 and 498 has an elastic layer and a resin layer with prescribed thicknesses. Then, pressure roller 497 is in pressure contact with pressure roller 493 and pressure roller 498 is in pressure contact with pressure roller 494, respectively through pressure belt 495 and fixing belt 491. Owing to this, a wide width of nip portion N can be secured. A high fixing characteristic and a high separation characteristic are secured at the nip portion N. In this case, the pressure roller 497 corresponds to a pressure member against pressure roller 493, and the pressure roller 498 corresponds to a pressure member against pressure roller 494. However, this may also be reversed, and it is desirable that the aforesaid plural cracks dispersed in different directions are formed in advance on pressure rollers 493, 494, 497 and 498.

A plurality of cracks dispersed in different directions mentioned above may exist close together continuously on the outer surface of resin layer 93C, when pressure roller 93 is not transformed.

Further, the aforesaid cracks may either be formed continuously from one end to the other end in the axial direction of pressure roller 93.

Furthermore, the cracks may be formed discontinuously when it has not been used, so that cracks may become larger by transformation at a nip portion to be continuous after pressure roller 93 is used.

Further, in the invention, a group of rollers called pressure rollers mean the members for giving pressure to an image on a transfer material such as a recording sheet, and which member is a member to be fixed actually, a member to be biased by a spring to apply a load to a corresponding member, or a member to be moved in the structure accompanied by touching and detaching is not limited.

For example, in the fixing device in FIG. 2, whether pressure roller 93 is fixed and outer pressure roller 94 is biased by a spring, or whether outer pressure roller 94 is fixed and pressure roller 93 is biased by a spring or whether pressure roller 93, fixing belt 91 and heat roller 92 are combined and biased by a spring are not limited for obtaining effects of the invention.

In the aforesaid embodiments, when an elastic layer of a roller used as a pressure roller in the belt-type fixing device is covered by a resin layer, an effect is exhibited that new cracks affecting adversely are not generated, even when a resin layer or an elastic layer is transformed by pressure in the nip portion.

What is claimed is:

1. A belt-type fixing device comprising:

an endless fixing belt;

a pressure roller arranged inside the fixing belt; and a pressure member which presses the fixing belt against the pressure roller, a toner image on a recording material being fixed in a nip portion formed between the fixing belt and the pressure member, wherein the pressure roller has an elastic layer which is made of solid rubber and a resin layer covering the elastic layer, a plurality of cracks extending from an outer surface of the resin layer to an outer surface of the elastic layer.

2. The belt-type fixing device of claim 1, wherein the plurality of cracks are formed in different directions on the resin layer.

3. The belt-type fixing device of claim 1, wherein the resin layer is formed by coating heat-resistant resin.

4. The belt-type fixing device of claim 1, wherein the resin layer is formed by causing powder of heat-resistant resin to attach to the elastic layer and burning the powder without causing fusion between particles of the powder.

5. The belt-type fixing device of claim 1, wherein the cracks exist closely together continuously on an outer surface of the resin layer when the pressure roller is not transformed.

6. The belt-type fixing device of claim 1, wherein the cracks are formed continuously from one end to another end in an axial direction of the pressure roller.

7. The belt-type fixing device of claim 1, wherein the cracks are formed discontinuously when the pressure roller has not been used, and the cracks become continuous after the pressure roller is used.

8. The belt-type fixing device of claim 1, wherein the fixing belt is wound around the pressure roller and a heat roller heated by a heating device.

9. An image forming apparatus having the belt-type fixing device of claim 1.

10. A belt-type fixing device comprising:

an endless fixing belt;

a pressure roller arranged inside the fixing belt; and a pressure member which presses the fixing belt against the pressure roller, a toner image on a recording material being fixed in a nip portion formed between the fixing belt and the pressure member, wherein the pressure roller has an elastic layer which is made of solid rubber and a resin layer covering the elastic layer, a plurality of cracks being formed on the resin layer so as to be substantially deep enough to arrive at the elastic layer and wherein the cracks are formed discontinuously when the pressure roller has not been used, and the cracks become continuous after the pressure roller is used.

11. A belt-type fixing device comprising:

an endless fixing belt;

a pressure roller arranged inside the fixing belt; and a pressure member configured to press the fixing belt against the pressure roller so that a toner image on a recording material may be fixed in a nip portion formed between the fixing belt and the pressure member, wherein the pressure roller includes an elastic layer and a resin layer covering the elastic layer, the resin layer having a plurality of cracks extending through a thickness thereof from a surface of the resin layer that touches the fixing belt.

* * * * *